United States Patent [19]

Moncrieff

[11] Patent Number: 4,596,034

[45] Date of Patent: Jun. 17, 1986

[54] SOUND REPRODUCTION SYSTEM AND METHOD

[76] Inventor: J. Peter Moncrieff, 2449 Dwight Way, Berkeley, Calif. 94704

[21] Appl. No.: 360,239

[22] Filed: Mar. 22, 1982

Related U.S. Application Data

[63] Continuation-in-part of Ser. No. 222,256, Jan. 2, 1981, abandoned.

[51] Int. Cl.[4] ..... H04R 1/02; H04R 3/00

[52] U.S. Cl. ..... 381/89; 381/111; 381/24

[58] Field of Search ..... 181/144, 145; 381/17, 381/24, 58, 59, 87–90

[56] References Cited

U.S. PATENT DOCUMENTS

| | | | |
|---|---|---|---|
| 2,145,318 | 1/1939 | Schenk et al. | 179/146 E |
| 2,203,715 | 6/1940 | Benecke | 381/89 |
| 3,022,377 | 2/1962 | Bobb et al. | 381/89 |
| 3,136,383 | 6/1964 | Hopkins | 181/145 |
| 3,241,631 | 3/1966 | Manieri | 179/146 E |
| 3,393,764 | 7/1968 | Schafer | 179/146 E |
| 3,400,217 | 9/1968 | Kraut | 381/90 |
| 3,720,787 | 3/1973 | Ishii et al. | 381/90 |
| 3,983,333 | 9/1976 | Allison | 381/58 X |
| 4,054,750 | 10/1977 | Montgomery et al. | 381/17 X |
| 4,199,658 | 4/1980 | Iwahara | 381/24 |
| 4,268,719 | 5/1981 | Manger | 381/89 |
| 4,276,446 | 6/1981 | Taddeo | 181/145 X |
| 4,284,844 | 8/1981 | Belles | 381/90 |
| 4,301,332 | 11/1981 | Dusanek | 179/146 E |

FOREIGN PATENT DOCUMENTS 2709952 9/1978 Fed. Rep. of Germany .

*Primary Examiner*—Gene Z. Rubinson
*Assistant Examiner*—W. J. Brady
*Attorney, Agent, or Firm*—Donald L. Beeson

[57] ABSTRACT

A sound reproduction system wherein two full range driver sets are employed to produce out-of-phase sound pressure lobes directed to either side of a listening area whereby the listening area is situated in the region of sound minimum pressure between drivers. The system decreases localization of speaker produced sound and enhances stereophonic and polyphonic effects.

13 Claims, 23 Drawing Figures

SOUND REPRODUCTION SYSTEM AND METHOD

CROSS-REFERENCES TO RELATED APPLICATIONS

This is a continuation-in-part of application Ser. No. 06/222,256 filed Jan. 2, 1981 and now abandoned.

BACKGROUND OF THE INVENTION

The present invention relates to sound reproduction generally, and particularly to a loudspeaker system and method for reproducing sound which decreases the localizability of the sound radiated by the loudspeaker's transducers and which enhances stereophonic or polyphonic perception.

Ideally sound reproduced through a loudspeaker would sound like the original source—a listener does not want to hear the loudspeaker but the source accurately and realistically recreated by the loudspeaker. This means that ideally the sound produced by the loudspeaker would have a spatial dimension or quality in that the listener would perceive the sound as being distributed in space as it would be if the source were heard directly. Unfortunately, a conventional problem with loudspeaker systems is the tendency of the sound produced by the loudspeaker systems to be localized at the loudspeakers themselves or imaged at a point relative to the loudspeakers.

Many different types of driver mechanisms have been employed to generate sound in loudspeaker systems. For example, horns, direct radiators, electrostatics, ribbons, and different systems have been used. Also, different loudspeaker systems have created different sound pressure patterns, such as unidirectional, bidirectional, multidirectional, cylindrical, and spherical, with the common feature that a lobe of maximum non-reflected sound pressure is generally directed at the intended listener. Despite the various approaches to sound reproduction, the problem of localization, and the related problems of providing true stereophonic or polyphonic effects, continues to be a persistent one.

The present invention provides a sound radiating system and method which substantially overcomes the localization problem by providing a unique approach in the manner in which the sound produced by the loudspeakers is radiated to the listener. It has been found that the hereinafter described aspects of the invention produce in the listener an enhanced sense of sound distribution and a decreased awareness that the sound is coming from speakers. The invention also provides for improved control over the characteristics of the audio information provided to the listener for improving the accuracy in the reproduced sound.

SUMMARY OF THE INVENTION

The present invention is a sound reproduction system having an audio signal input and first and second transducer means, each of which generates an acoustical output in response to an audio signal impressed on the audio signal input and each of which has a sound pressure distribution or polar pattern characterized by a sound pressure lobe projecting forwardly of the transducer. In accordance with the invention each of the first and second transducer means is adapted to reproduce the full audio range of the individual sound reproducing system. Also in accordance with the invention the output of the first transducer means is 180° out of phase with respect to the output of the second transducer means. The transducer means are positioned such that their outputs, that is, sound pressure lobes, are directed to either side of a listener positioned in a listening area in front of the system. The transducers can be directed oppositely of each other such that their out of phase pressure lobes are directed outwardly from the system in opposite directions and laterally with respect to the listening area. The listening area will thus be situated endwise with respect to pressure lobes of the transducers in an area of minimum sound pressure. The transducers can alternatively be rotated symmetrically toward the listening area such that the pressure minimum between the two out of phase pressure lobes will remain directed at the listening area.

The method of the invention involves directing out of phase sound pressure lobes from first and second transducer means to either side of the listening area, for instance in opposite directions and laterally with respect to the listening area, or rotated toward the listening area, with the pressure minimum remaining directed at the listening area.

Refinements to the invention include crossfeed between transducers, fixed and variable attenuation of transducer outputs, and delay.

Different types of transducer or driver mechanisms, operating on various physical principles, configured in several embodiments, are applicable to the invention. Types of possible driver mechanisms include electrodynamic, electrostatic, ribbon, orthodynamic, polymer film, piezoelectric, moving gas (ionic or plasma), and pleated squeezer (Heil air motion transformer). Types of enclosures include single box, double box, and open panel. These enclosures may be of any shape (rectangular, cylindrical, spherical, egg, open back box, etc.). Combinations of driver mechanism and enclosure types may be used in different configurations (including point source and line source geometries). Multiples of these systems can be used to create stereophonic or polyphonic systems.

It is therefore a principal object of the invention to provide a sound reproduction system and method which provides a sound pressure radiating field of acoustical energy from two out-of-phase acoustical sources within the system so as to provide a sound field at the listener which substantially prevents the listener from localizing the speakers. As will be discussed, it is particularly contemplated that more than one monophonic system in accordance with the invention can be employed to the same effect to provide stereophonic or polyphonic sound. Other objects of the invention will be apparent from the following specification and claims.

DETAILED DESCRIPTION OF PREFERRED EMBODIMENTS

Figure 1:
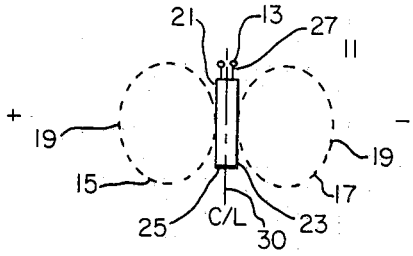
FIG. 1 is a pictorial illustration of a monophonic sound reproduction system in accordance with the present invention.

Referring now to the drawings, FIG. 1 pictorially illustrates a sound reproduction system in accordance with the invention wherein a sound transducer system 11 is driven by an audio input signal at input 13 to produce a sound distribution pattern characterized by sound pressure lobes 15, 17. Each sound reproduction system 11 is particularly characterized by separate first and second transducer means, hereinafter described in detail, each of which produces one of the separate illustrated sound pressure lobes 15, 17 from the same input signal 13; the system is also characterized by the fact that each sound pressure lobe 15, 17 will be 180° out of phase from the other. That is, the transducer means, which can consist of a variety of driver types and arrangements as hereinafter described, responds to the audio input signal by producing sound directed from the left of the system 11 (left pressure lobe 15) which is 180° out of phase from the sound directed from the right of the system (right pressure lobe 17) as indicated by the + and − associated with the respective pressure lobes. Each sound pressure lobe represents a sound pressure distribution pattern for first arrival (non-reflected) sound for the full frequency range of the system and maximum sound pressure level is represented by the radially furthest points 19 on the lobe patterns 15, 17.

It should be noted that, as seen in in FIG. 1, the first and second transducer means or driver systems are simply represented by, respectively, the left side 21 and the right side 23 of the box representation of the overall transducer system 11; the box ends 25, 27 face in a direction perpendicular to the direction of the lobe maxima 19 and thus in the direction of minimum radiated sound pressure. As described hereinafter, the maximum points 19 of pressure lobes 15, 17 may be rotated towards the box end 25, which remains the direction of minimum radiated sound pressure.

The defined listening area for the system illustrated in FIG. 1 is represented by an encircled area 29 in which the "x" represents the listener. Unlike conventional systems, the listening area is situated midway between the pressure lobes 15, 17 in the area of minimum sound pressure, such that the transducer means is endwise directed at the listener; the opposite pressure lobes appear as being directed perpendicularly to, or on either side of, the listener relative to the system center line 30. It is found that radiating sound to the listener with a sound distribution pattern as described reduces localization problems and enhances stereophonic and polyphonic effects. This is true even if the opposite pressure lobes 15, 17 are symmetrically rotated toward the listener 29.

Figure 2:
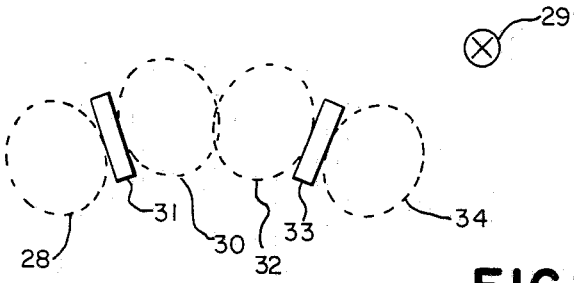
FIG. 2 shows two of the sound reproduction systems of FIG. 1 configured to create a stereophonic sound field.

FIG. 2 illustrates how two sound reproduction systems 31, 33 such as described in FIG. 1 can be combined so that each system endwise faces the listening area 35. The listening area is situated in the area of sound pressure minima of the opposite polarity pressure lobes 28, 30 and 32, 34 associated with each of the systems 31, 33. It is understood that more than two sound reproduction systems of the invention could likewise be employed.

Figure 3A:
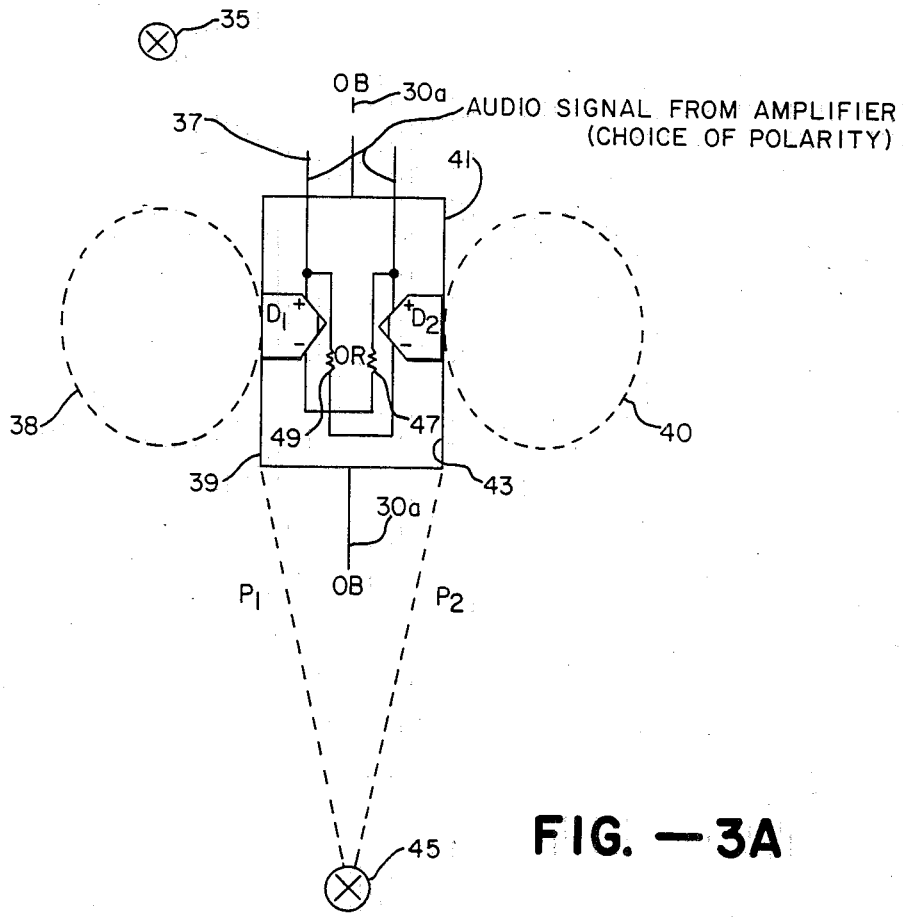
FIG. 3A is a more detailed schematic illustration of the sound reproduction system shown in FIG. 1.

FIG. 3A shows a more detailed single box enclosure embodiment of the sound reproduction system of FIG. 1, wherein first and second transducer means in the form of a matched set of drivers D1 and D2 placed in the sides 39, 41 of the enclosure 43 are wired to an audio signal input 37. Unlike the prior art, drivers D1 and D2 are connected 180° out of phase to one another and are not situated to direct a single, simple sound pressure lobe maximum at the listener. It should be noted that each of the drivers, D1 and D2, may be comprised of a multiplicity of driver mechanisms (e.g. woofer, midrange, tweeter) to provide a full range capability for each driver set, and to provide alternative source radiating geometries (e.g. point source, line source).

FIG. 3A best illustrates the principle of operation of the sound reproduction system of the invention. When the listener is situated in listening area 45, the distances P1 and P2 are the same. Hence the system of this invention with oppositely directed sound pressure lobes 38, 40 will direct a pressure minimum or null at the listener for all frequencies generated by the matched pair of drivers D1 and D2, connected in opposite polarity. Optional fixed or user adjustable resistors 47, 49 can attenuate one lobe relative to the other, causing a modification of the radiating pattern of the lobes 38, 40, and an angular shift in the pressure minimum. With user adjustable resistors the listening area 45 can be passively moved off center without turning the system.

Figure 3B:
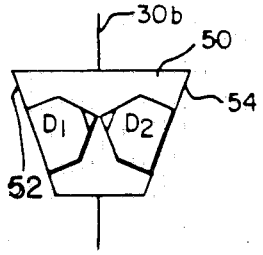
FIG. 3B is a schematic illustration of an alternative embodiment of the sound reproduction system shown in FIG. 3A, and particularly showing an alternative placement for the two driver systems of the invention.
Figure 3C:
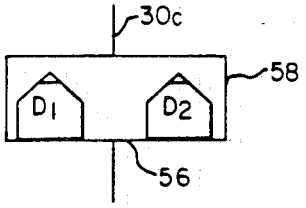
FIG. 3C is yet another alternative embodiment of the sound reproduction system shown in FIG. 3A showing another alternative placement for the driver systems thereof.

As noted above, the driver set D1, D2, to be in accordance with the invention can be rotated toward the listening area in order to toe in the sound pressure lobes 38, 40. For example, FIG. 3B shows a single box enclosure 50, such as the enclosure 41 of FIG. 3, with slanted sides 52, 54. This version is advantageous when the drivers D1 and D2 have limited dispersion capability in their upper frequencies. FIG. 3C in turn shows the two drivers D1 and D2, still connected in opposite polarity, brought around to the front wall 56 of the single box enclosure 58. All versions shown in FIGS. 3A–3C are shown with optional baffle boards 30*a*, 30*b*, 30*c* aligned with the listening area, such as listening area 45 of FIG. 3A, to minimize the effects of out-of-phase local pressure cancellations at lower frequencies.

Figure 4A:
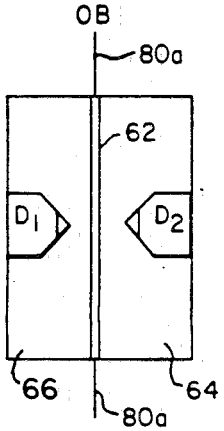
FIG. 4A–4C are schematic illustrations of the sound reproduction system of FIGS. 3A–3C showing the use of an alternative double enclosure for the driver systems.
Figure 4B:
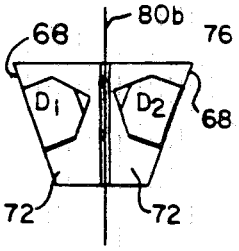
Figure 4C:
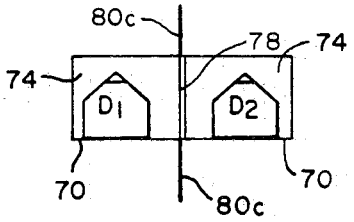

FIGS. 4A–4C show double box embodiments of the invention. In FIG. 4A a box enclosure 60 has a midwall partition 62 which divides the enclosure into separate chambers 64, 66 in which the out of phase drivers D1 and D2 are mounted facing opposite directions; in FIGS. 4B and 4C the drivers D1, D2 are mounted in, respectively, the slanted walls 68 and the front wall 70 of their respective enclosures in separate chambers 72, 74 created by midwall partitions 76, 78. As in the previously described embodiments, each driver set can preferably be provided with external baffle board 80*a*, 80*b*, 80*c*, to minimize the effects of out-of-phase local pressure cancellations at lower frequencies.

An advantage of the FIGS. 4A–4C implementations over the single box system of FIGS. 3A–3C is that the delayed back wave from driver D1 does not reach and interfere with driver D2, and vice versa. The double chamber embodiment may be achieved by installing a partition, such as partition 62 in FIG. 4A, in a single enclosure or by installing two enclosures back to back. Conversely, the single box enclosure embodiment has an advantage over the double box enclosure embodiment in that the internal enclosure volume is irrelevant to the system's bass cutoff, and therefore this volume may be made arbitrarily small. This irrelevancy of internal enclosure volume is an advantageous feature unique to this invention, not shared by prior art loudspeaker enclosures. Since the single box enclosure volume may be made arbitrarily small, the driver D1 may be placed very close to driver D2, so the delay of the back wave from one to the other affects only higher audio frequencies. It is then easy to damp out these higher frequencies of the back wave, using absorbent materials stuffed into the single box enclosure.

Figure 5A:
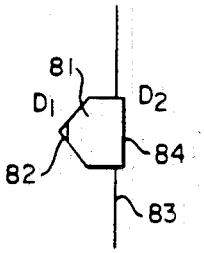
FIG. 5A–5C are schematic illustrations of sound reproduction systems in accordance with the invention wherein the driver systems are mounted on open panels rather than inside enclosures.
Figure 5B:
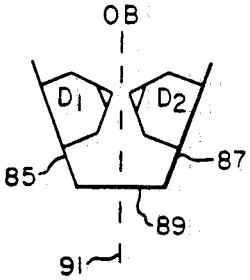
Figure 5C:
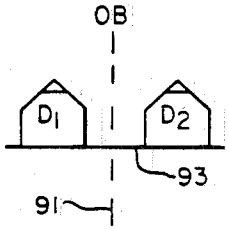
Figure 5D:
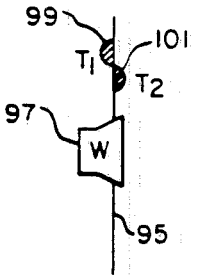
FIG. 5D is a more detailed illustration of the sound reproduction system of FIG. 5A showing an open backed woofer and dual tweeters.

FIGS. 5A–5D show open panel embodiments of the invention wherein a box enclosure such as shown in FIGS. 3A–3C and 4A–4C are eliminated. Referring to FIG. 5A, an integral bidirectional driver set D1, D2, which is an open back driver denoted by the numeral 81, is mounted on a planar baffle board 83. In FIG. 5B the open-back drivers D1, D2 are mounted in the two angled sides 85, 87 of a forwardly facing bent panel 89 with an optional baffle board 91 isolating the drivers. In FIG. 5C the drivers D1, D2 are mounted on a planar forwardly facing panel 93 with optional baffle board 91. In FIG. 5D the drivers are mounted on a planar endwise panel 95. In the FIG. 5D embodiment the driver set D1, D2 are shown as a separate low frequency, open back woofer 97, and two oppositely facing, out of phase tweeters 99, 101.

With the embodiments illustrated in FIGS. 3A–3C and 4A–4C, there is external path cancellation between D1 and D2 at low frequencies, depending on the length of this external path. At these low frequencies, the system no longer exhibits the described sound pressure patterns (see FIGS. 1, 2 and 3A), since radiated pressure is cancelled for all polar axes, not just the endwise axis directed at the listener. The internal box enclosure volume is irrelevant to this phenomenon in all embodiments. Therefore, the box enclosure may be eliminated as shown in FIGS. 5A–5D implementations. Referring to FIGS. 5A–5D is noted that the optional baffle boards 91 shown in FIGS. 5B and 5C may be added to lengthen the external acoustical path between drivers D1, D2, while the open panels 83, 95 of FIGS. 5A and 5D themselves serve as baffle boards.

A further advantage of the configuration shown in FIG. 5A is that for all driver mechanisms that are open backed a single driver mechanism 81 can be used for both drivers, D1 and D2. The back 82 of the driver mechanism functions as driver D1 and the front 84 of the mechanism as D2. If an assortment of driver mechanisms (e.g. a woofer 97 and tweeters 99, 101 in FIG. 5D) is used to create a full frequency range system, but some mechanisms are open backed (e.g. the woofer 97 in FIG. 5D) and others are closed backed (e.g. the tweeters 97, 101), then the open backed driver mechanism can be used singly, but the closed backed driver mechanism must be used in oppositely facing pairs.

Stereophonic and Polyphonic Systems

Figure 6:
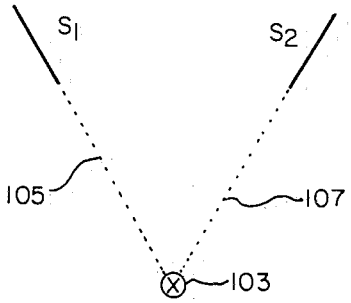
FIG. 6 is a pictorial representation of a pair of sound radiating systems of the invention directed for stereophonic effect as shown in FIG. 2.

Referring generally to FIGS. 6,7, 8A and 8B a pair of sound reproducing systems S1, S2 in accordance with the invention can be utilized for generating a stereophonic sound field in a listening area, the location of which is generally denoted by the numeral 103. Multiples can be used for polyphonic sound field generation. In order to operate properly, each of the reproduction systems S1 and S2 should be directed endwise at the listening area 103 such that their pressure radiation minima intersect, as represented by dashed lines 105, 107 in FIG. 6, at this area. For example, two of the embodiments shown in FIG. 5A should be arranged as shown in FIG. 6 to arrive at the first approximation of a stereophonic system.

The angular alignment of each system S1, S2 can be made to be extremely critical with respect to the listener's head location 103, because with a narrow angle of the pressure null or minimum 105, 107. This critical alignment is exploited to advantage in order to partially cancel unwanted crossfeed from the left speaker to the right ear of the listener, and from the right speaker to the left ear, which degrade perception of the stereophonic sound field and allow a listener to localize prior art loudspeakers in his listening room. For example, the left system S1 may be precisely aligned with the listener's left ear (rather than the center of his head), and the right system S2 with the right ear. Or the left system S1 may be precisely aligned with the listener's right ear, and the right system S2 with the left ear. This precise alignment of the invention can be so successful at eliminating unwanted crossfeed, that the need is obviated for inverted polarity electrical signal interchannel crossfeed, as described hereinafter or as practiced by prior art.

Figure 7:
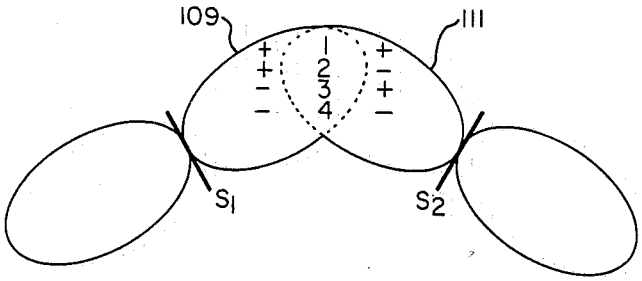
FIG. 7 is the stereophonic configuration of FIG. 6 showing the four possible phase polarity choices for the intersecting or adjacent sound pressure lobes.

Referring to FIG. 7 the two systems S1 and S2 are seen as having pressure lobes 109, 111 approximately facing each other. This schematic should be understood as covering the use of embodiments such as shown in FIGS. 3B, 3C, 4B, 4C; 5B, 5C where the sound pressure lobes of each system S1, S2 are rotated forward toward the listening area, as well as embodiments having laterally directed lobes as shown. In FIG. 7 two intersecting or facing pressure lobes 109, 111 may be made to be in phase or 180° out of phase by suitably wiring the polarity of S1 and S2. There are four possible polarity choices, and no one polarity connection choice is correct (in the traditional sense of all prior art), since the listener is not situated in a simple pressure lobe, as he conventionally is. With the system of the invention different polarity connection choices yield different stereophonic sound field perceptions; and some are very good at preventing the unwanted localizability of the speakers in the room by the listener and at enhancing the desirable stereophonic perception of the original sound field encoded in the music recording.

In pursuit of this same goal of decreasing speaker localizability and enhancing stereophonic perception, prior art loudspeaker systems and electronic signal processors have employed signal crossfeed of inverted polarity, and possibly delayed in time. This invention also uses these concepts, but in the unique manner of the invention described below.

Figure 8A:
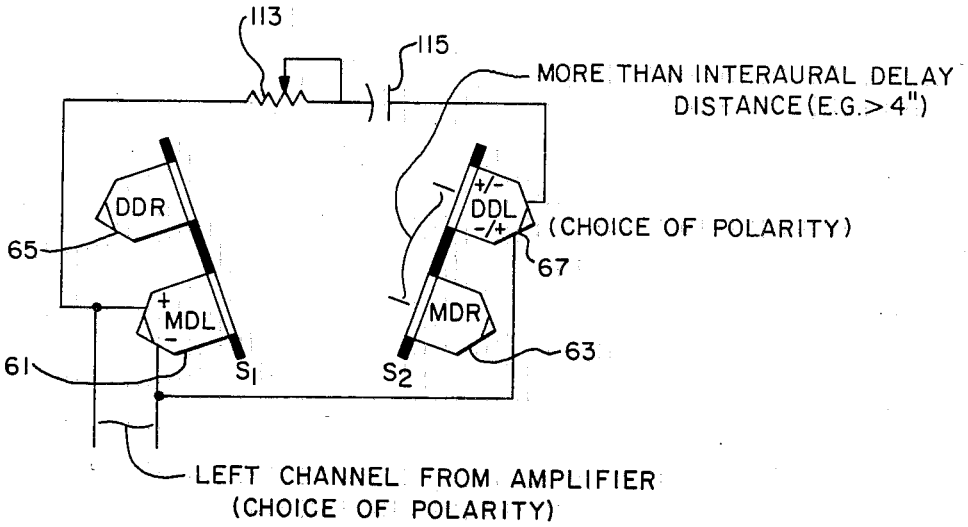
FIG. 8A is a schematic illustration of a sound reproduction system in accordance with the present invention showing acoustical crossfeed with acoustical delay and polarity inversion (only left channel signal feed is shown).

Referring to FIG. 8A, there is shown a stereophonic sound reproduction system employing crossfeed and acoustical delay by means of properly wired left and right main open back driver systems 61, 63 and left and right delay open back driver systems 65, 67. In accordance with the invention all driver systems 61, 63, 65, 67 represent separate sound reproduction systems as described in connection with FIGS. 1-5 and directed as shown in FIGS. 6 and 7. Again the separate sound systems are illustrated by the directed planes represented generally by S1 and S2. The drivers mechanisms 61, 63, 65, 67 are connected via wires and circuit elements as follows: the left main driver system 61 is connected and crossfed to the right delay driver system 67 mounted with the right main driver system 63; the right main driver system 63 in turn is connected and crossfed to the left delay driver system 65 mounted with the left main driver system 61 (this wiring is not shown).

Unlike conventional crossfeed and delay systems, the illustrated system of the invention requires no electronic processors or transfer circuits for delay, polarity inversion, frequency contouring, or crossfeed mixing. Also, with the invention the delayed drivers can be on the same plane as the main drivers or a plane parallel thereto. Some prior art systems accomplish their delay and polarity inversion acoustically, but do not include crossfeed. The present invention in the FIGS. 8A and 8B embodiments uniquely accomplish all three (crossfeed, delay, and polarity inversion) acoustically, by employing the second set of delay drivers 65, 67, placed coplanar or in a parallel plane with the main driver set 61, 63, which are further from the listener and which are thus delayed. It is noted that in this invention the plane of the drivers S1, S2 is not orthogonal to the mean center path to the listener (see FIGS. 8A and 8B), and that polarity inversion is optional when using sound reproduction system of the invention. In the invention the attenuation of the crossfed signal can be user adjustable by circuit means such as a rheostat 113 as shown in FIG. 8A.

Figure 9:
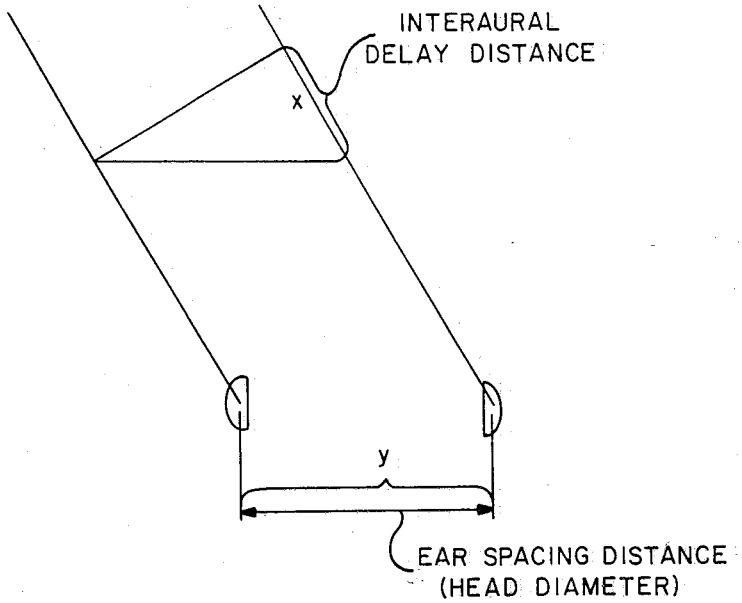
PRIOR ART FIG. — 9
FIG. 9 illustrates the derivation of the delay as used in conventional delay schemes.
Figure 8B:
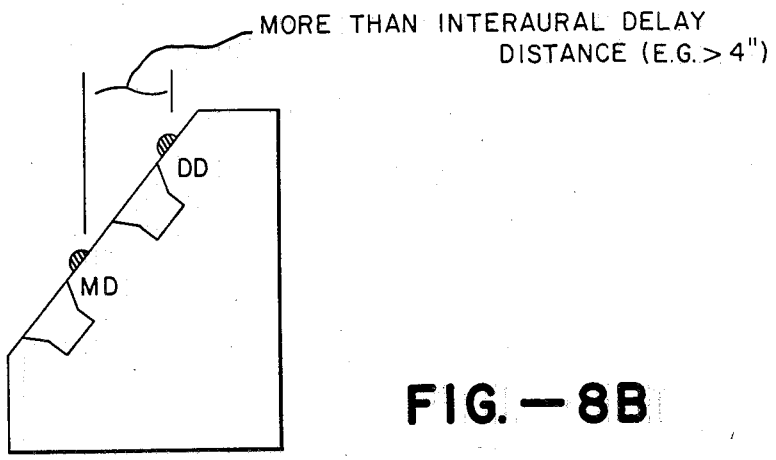
FIG. 8B is a side elevation view of a speaker such as can be used in the system of FIG. 8A, particularly showing the mounting of the main driver system relative to the delay driver system.

With reference to FIG. 9, the delay time of the secondary delayed signal of a conventional system employing delay techniques is conventionally set to equal the path length time difference between sound reaching the two ears from one speaker. The difference or set delay, x, is shown in FIG. 9, which represents the conventional delay choice . The maximum listening angle recommended by experts is 30° to each speaker, yielding a maximum 3.5 inch difference for a 7 inch diameter human head denoted "y" in FIG. 9. Thus a conventional delay would come to approximately 270 microseconds, corresponding to a path length delay of about 3.5 inches. Some prior art systems add multiple further delays. In contrast, the present invention contemplates using a single path length delay that is more than the interaural path length difference (e.g. more than 4 inches for a 30° listening angle). This was experimentally found to be optimal for the special characteristics of the sound reproduction system of the invention.

It is further noted in reference to FIG. 8A that conventional speaker systems contour the frequency response of the secondary, delayed signal by rolling off the treble. In contrast, the present invention does not roll off the treble of the secondary signal which is radiated from the separate delay drivers 65, 67.

It is still further noted that, with the small 3.5 inch delay conventionally employed, severe cancellation occurs in the treble for a correlated center signal fed from both channels of a recording. In contrast, with the greater delay utilized in this invention (typically over 8 inches, the distance between the human pinnae), the cancellation is moved down in frequency into the mid-range frequencies (typically 1500 Hertz). This cancellation is then avoided in this invention by rolling off the bass (typically below 1500 Hertz) fed to the delayed, secondary drivers. The series capacitor 115 shown in FIG. 8A serves this bass rolloff function.

A further unique property of the stereophonic version of this invention is that the primary and secondary (delayed) signal emanating from, for example, the left speaker system can be made in-phase for a correlated center signal fed from both program source channels. This is accomplished by wiring the two primary drivers in opposite polarity (two choices in FIG. 7), or by not inverting polarity to the delayed drivers 65, 67. One advantage of this is that it moves the cancellation frequency one octave lower (typically 750 Hertz), allowing yet more of the frequency spectrum to be fed to the secondary, delayed driver set without cancellation.

Adaptation of the Invention

Figure 10A:
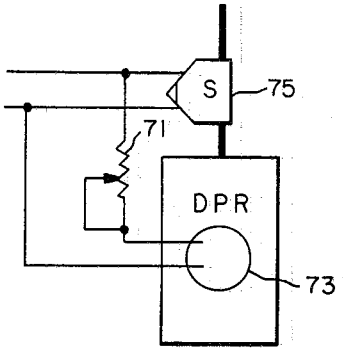
FIGS. 10A and 10B show two combinations of sound reproduction system in accordance with the invention, as used with a conventional on-axis pressure radiator.
Figure 10B:
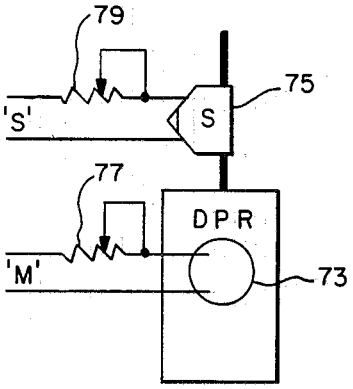

A sound reproduction system as illustrated in FIG. 1 can be combined with a conventional forward facing or pressure radiating loudspeaker system. One possibility is shown in FIG. 10A. The optional resistor 71 serve to attenuate the direct pressure radiator 73, and is adjusted to optimize the balance for the listener between the on axis pressure lobe and the sound reproduction system of the invention denoted 75. The same system, when rewired as shown in FIG. 10B, could be used for the reproduction of unmatrixed M-S stereo miked recordings. The adjustable attenuators 77, 79 shown could be used by the listener to change the mix of direct to ambient sound picked up by the "M" microphone vs. the "S" microphone, respectively.

Further Refinements

1. Utilizing Room Boundary Loading.

Prior art loudspeakers have been designed for flat anechoic response, and have ignored the effects of boundary loading upon low and mid frequency response. U.S. Pat. No. 3,983,333 to Allison points this out and describes boundary loading as a phenomenon to be avoided by correct design. The Allison designs still attempt flat anechoic response, and then specifically attempt immunity from boundary loading effects. This invention, unlike all prior art, specifically exploits boundary loading effects to advantage. It is designed for non-flat anechoic response, and then utilizes boundary loading variation as part of the speaker design itself to flatten the response.

In discussing FIGS. 5A–5C, 6 and 7 it was pointed out that low frequency pressure cancellation occurs with the sound reproduction system of the invention because of external path length—an internal enclosure volume and design is irrelevant. Thus the only way to extend low frequency response is with a very large baffle, impracticable for home use.

Figure 11:
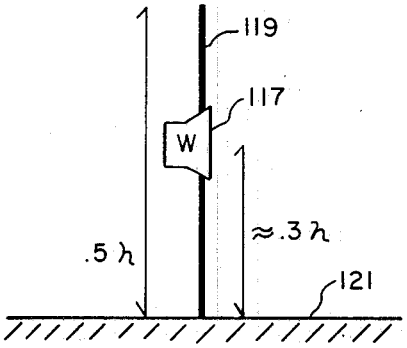
FIG. 11 illustrates the utilization of the present invention and the room boundaries to exploit the loading rise in power output.

The baffle's reponse due to cancellation rolls off at 6dB per octave (which is desirable for good transient response). Allison's studies show a gentle loading rise with lower frequency, below the notch frequency caused by single boundary loading and reflection distance (about 3 tenths wavelength where the wavelength is for the 3db down frequency loading). Allison's prior art efforts are to avoid this rise, and flatten the response effect by appropriate driver location (very close to boundaries). In contrast, this invention exploits this rise, retaining it and fixing its frequency by appropriate driver location away from a convenient boundary (the floor and/or wall is used). This loading rise is placed so as to offset the fall from baffle pressure cancellation. The two adjusted parameters are these: size of baffle and driver distance from floor/wall, parameters which are illustrated in FIG. 11 where a low frequency driver 117 is shown mounted approximately 3 tenths wavelength from a room boundry such as the floor 121. Just as pressure cancellation begins to drop the response with lower frequency from the limited baffle board size (less than 5 tenths wavelength) the increased acoustic loading upon the mid-bass driver (and narrower radiating angle in steradians) begins to raise its response with lower frequency due to the distance between the mid-bass driver and the floor/wall having become critical at that wavelength. The two effects offset each other, resulting in approximately flat response, and permitting the utilization of a far smaller baffle size. (This technique is also applicable to woofers for low bass frequencies; for this, placing a second woofer 1 wavelength away on the baffle would further aid reinforcement below the baffle's cutoff frequency.)

At yet lower frequencies, the mid-bass driver has become fully loaded by the additional boundary or boundaries, and this effect flattens out. At this point the system response drops off due to baffle cancellation. But this frequency is low enough so that the loaded baffle's 3 dB point is about 100 Hz (with a convenient baffle size), low enough to interface with the subwoofer.

2. Transient Response.

The midrange/upper bass driver is chosen to have a superfluously low free air resonance (e.g. 30 Hz); it is actually a woofer driver (if the driver Q is too low for open baffle use, it may be raised with a series resistance). In the open baffle and single box embodiments of the invention, this low resonant frequency is not raised by (arbitrarily small) box volume, unlike prior art. Thus the external baffle cancellation becomes the dominant single pole rolloff for a large frequency span, which ensures good system transient response. A second real pole is introduced in the invention to lower modulation distortion of the midrange due to excess cone excursion; this second pole is a series capacitor. The driver resonance and its 2 additional poles (with imaginary component) do not come in until a lower frequency, by which point the amplitude response of the invention has been significantly reduced. Thus the invention offers bass transient response that is superior to prior art, wherein two or more complex poles are at the edge of the passband and thereby degrade transient response at full amplitude.

The subwoofer's low pass filter is also single pole to effect good system transient response. The subwoofer driver is therefore chosen to have 'superfluously' well behaved response up to about 1000 Hz, for a system cutoff of 100 Hz.

3. Avoiding Coherent Interference.

The higher frequency crossovers are likewise single pole for good transient response. In most prior art loudspeakers this would impose considerable strain on the tweeters (one per side). However, if this invention uses sealed back tweeters, then 8 must be employed for a simple stereo array (2 for each of the invented driver systems, left and right, front and delayed), so they share the burden of creating loud volume levels.

Attempts to share the power load among multiple tweeters (or midranges, etc.) in prior art loudspeakers have all resulted in severe, well defined axial pressure interference patterns and lobing; that is because all tweeters are fed the same signal. This invention is unique in its use of multiple tweeters (or other drivers) fed with different signals (assuming stereo program material), and/or delayed significant amounts. Thus all resulting interference patterns are complex and continually varying with the music. This mimics the complex, sharp, ever changing comb filtering that actually occurs at a live concert. It is very difficult for the ear to detect this complex interference as anything adverse. In contrast, with prior art usage of multiple axial pressure drivers fed identical information, the simpler, more constant interference patterns are easy for the ear to pick out, and they have been very objectionable.

Additionally, with this invention the tonal balance of the perceived sound field is remarkably uniform throughout the room, as is the radiated power response (if suitably measured). This is due to the wide dispersion of the drivers employed and to complexity of any interference patterns.

4. Reducing Distortion.

All prior art axial pressure loudspeakers are subject to perceived FM (Doppler) distortion which has been shown to be detectable and objectionable in minute amounts. This distortion is due to the axial displacement of the drivers with respect to the listener while playing. This invention eliminates this distortion, by having the drivers' displacement be transverse instead of axial with respect to the listener.

Additionally, operation of some of the drivers in opposing pairs, operating in push-pull, is effective in reducing even order nonlinearities that may be present in each driver's functioning. It is also conjectured that this invention's utilization of even a single driver (radiating from both sides of its diaphragm) in transverse velocity radiating mode would reduce the perceived even order nonlinearities, since asymmetries in the displacement function would not affect the amplitude of the transverse velocity function.

5. Phase Alignment without Cabinet Diffraction.

Figure 12:
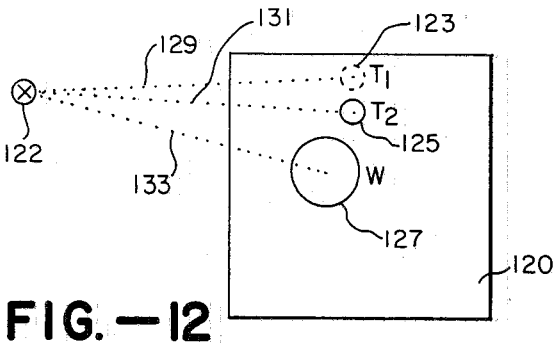
FIG. 12 illustrates in a side elevational view a technique for achieving phase alignment between coplanar mounted driver mechanisms as might be used in the present invention.

Some prior art loudspeakers have successfully aligned the phase of the slower low frequency drivers with the phase of the faster high frequency drivers by physically placing the high frequency driver farther away from the listener than the low frequency driver. Similar considerations apply to crossfeed delay. With prior art loudspeakers, such offset for phase alignment requires a segmented baffle mounting board, with resulting problems of diffraction, reflection, and loading variation. However, with this invention, the baffle board can be axial to the listener. So the higher frequency driver can be mounted above but slightly to the rear of (instead of simply above) the lower frequency driver, with no segmenting of the baffle board and none of the attendant problems. The drivers are phase aligned for an average angular line of sight to the loudspeaker, which involves an average height listener sitting at an average distance. For example, in FIG. 12 the distances between the tweeters 123, 125 and the listener at 122, and the woofer 127 and the listener, are depicted by the radial lines 129, 131, 133. It can readily be seen that location of the drivers on a single planar baffle board 120 can be used for proper phase alignment.

6. Elimination of Cabinet Radiation and Diffraction.

With virtually all prior art loudspeakers, the cabinet and front panel (not to mention raised edges, etc.) act as significant diffractors and secondary radiators of sound waves. This smears the radiated early arrival information in both time and space. It has been shown that these adverse effects can be significantly reduced by employing a spherical or long cylindrical shape for the cabinet face that faces the listener. One embodiment of this invention, shown in FIG. 13, utilizes a front cabinet face that is entirely and purely cylindrical, without interruption. The inventor's experiments have demonstrated that this significantly improves stereo imaging and musical clarity.

Figure 13:
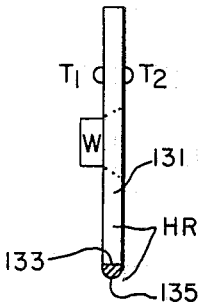
FIG. 13 is a top plan view of a speaker panel showing the half round sections used for achieving purely cylindrical cabinet edges.

The technique for achieving a purely cylindrical front cabinet face is straightforward with this invention. As shown in FIG. 13 the baffle board is ½ to 1 inch thick, and its edge 133 faces the listener; this edge thus constitutes the front face of the cabinet that launches early arrival sound waves. A half round section length 135 secured to this cabinet edge provides a pure cylindrical front for the entire cabinet face. The other baffle edges are also made cylindrical. Prior art loudspeakers with forward facing drivers may attempt cabinet front rounding or edge tapering, or even spherical cabinets, but always have had to interrupt their desired shape for the drivers themselves.

7. Mounting Holes.

Figure 14:
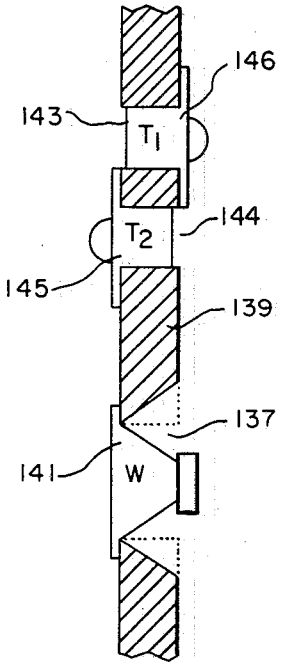
FIG. 14 is a cross-sectional elevational view of a speaker panel showing tapered mounting hole for an open backed driver mechanism and the overlapping of closed backed drivers.

Referring to FIG. 14, the mounting hole 137 in the baffle board 139 for the open backed driver mechanism 141 (e.g., woofer) is tapered in cross-section to avoid cylindrical cavity resonances of the mounting hole. The mounting holes 143, 144 for the closed back driver mechanisms 145, 146 (e.g., dome tweeters) are drilled closer than the mounting plates nominally allow, to get the back to back drivers positioned as close as possible in opposite sides of the baffle, for the sake of coherent radiation.

The sound reproduction system of the invention and particularly as illustrated in FIG. 1 should be very critical to align, so that the listener is really sitting at the pressure null. The inventor has determined that his various embodiments reduced to practice are indeed very critical of alignment (though general room placement is quite flexible). The generated image and musical quality changes perceptibly if the invention is misaligned by merely 5 minutes of arc. Obviously the radiator is not depending on wall reflections for its effect, as some prior art multiple radiation loudspeakers do.

Although the present invention has been described in considerable detail in the above specification, it is not intended that the invention be limited to such detail except as necessitated by the appended claims.

I claim:

1. A sound reproduction system for providing sound to a defined listening area, said system comprising a common audio input for a single channel electrical audio signal, first and second transducer means, each of which generates an acoustical output in response to the single channel electrical audio signal impressed on said audio input, each of which has a sound pressure distribution pattern characterized by a sound pressure lobe directed forwardly of said transducer means on a forward axis defined by the sound pressure maximum, and each of which is adapted to reproduce substantially the full audio frequency range of said sound reproduction system wherein the audio frequency range of said system includes at least a portion of the audio frequency spectrum above low frequencies, said first and second transducer means further being responsive to the single channel electrical audio signal to said audio input and being electrically connected in opposite phase polarities with respect to said common audio input so that the acoustical output of said first transducer means is substantially 180° out of phase from the acoustical output from said second transducer means, and structural means for supporting said first and second transducer means in a closely spaced, side by side, relation whereby the forward axes of the sound pressure lobes of said first and second transducer means have a substantial closely spaced, single channel component in the same direction.

2. The sound reproduction system of claim 1 wherein said first and second transducer means are supported by said structural means in substantially coplanar relation such that the second pressure lobes of said first and second transducer means are directed substantially in the same direction.

3. The sound reproduction system of claim 1 including attenuation means for attenuating the output lobe of one of said first and second transducer means relative to the output lobe of the other.

4. The sound reproduction system of claim 1 wherein said said structural supporting means comprises a single box enclosure.

5. The sound reproduction system of claim 1 wherein said structrual supporting means comprises a double box enclosure having two separate chambers, said first transducer means being mounted in one of said chambers and said second transducer means being mounted in the other of said chambers.

6. The sound reproduction system of claim 1 wherein said structural supporting means comprises a planar baffle board.

7. The sound reproduction system of claim 1 wherein said first and second transducer means are acoustically separated by an external baffle board to minimize the effects of out-of-phase local pressure cancellations at lower frequencies.

8. The sound reproduction system of claim 5 wherein said double box enclosure is comprised of physically separate enclosures.

9. The sound reproduction system of claim 1 wherein the audio frequency range of said system includes at least the mid and high frequency ranges of the audio frequency spectrum.

10. The sound reproduction system of claim 1 wherein the audio frequency range of said system includes at least the midrange frequencies of the audio frequency spectrum.

11. A method of radiating sound to a listening area comprising the steps of directing to said listening area two closely spaced matched transducer means adapted to produce acoustical outputs over at least a portion of the audio frequency spectrum above low frequencies, and driving said match transducers means from a common, single channel, electrical audio signal such that the acoustical outputs thereof are 180° out of phase relative to each other for achieving a null at the listening area.

12. The method of claim 11 wherein said two matched transducer means cover at least the mid-range frequencies of the audio frequency spectrum.

13. The method of claim 11 wherein the said two matched transducer means cover at least the mid and high frequency ranges of the audio frequency spectrum.

* * * * *